US005647768A

United States Patent [19]

Messuri et al.

[11] Patent Number: 5,647,768

[45] Date of Patent: Jul. 15, 1997

[54] PLATED PLASTIC FILTER HEADER

[75] Inventors: Dominic Anthony Messuri, Canfield; Burlyn Dean Nash, Warren, both of Ohio

[73] Assignee: General Motors Corporation, Detroit, Mich.

[21] Appl. No.: 613,862

[22] Filed: Mar. 11, 1996

[51] Int. Cl.[6] ..... H01R 13/66

[52] U.S. Cl. ..... 439/620; 439/931

[58] Field of Search ..... 439/620, 931; 333/181–185

[56] References Cited

U.S. PATENT DOCUMENTS

| | | | |
|---|---|---|---|
| 4,880,397 | 11/1989 | Dawson, Jr. et al. | 439/620 |
| 4,929,196 | 5/1990 | Ponn et al. | 439/620 |
| 5,018,989 | 5/1991 | Black et al. | 439/620 |
| 5,141,454 | 8/1992 | Garrett et al. | 439/931 |
| 5,141,455 | 8/1992 | Ponn | 439/620 |
| 5,151,054 | 9/1992 | Briones et al. | 439/620 |
| 5,228,871 | 7/1993 | Goodman | 439/931 |
| 5,286,221 | 2/1994 | Fencl et al. | 439/620 |
| 5,399,099 | 3/1995 | English et al. | 439/417 |
| 5,415,569 | 5/1995 | Colleran et al. | 439/620 |
| 5,509,823 | 4/1996 | Harting et al. | 439/931 |
| 5,509,825 | 4/1996 | Reider et al. | 439/620 |
| 5,564,948 | 10/1996 | Harting et al. | 439/931 |

*Primary Examiner*—Gary F. Paumen
*Attorney, Agent, or Firm*—Cary W. Brooks

[57] ABSTRACT

This invention includes a filtered header electrical connector including a connector body having a reduced mass underlying a surface-mounted chip capacitor. The reduced connector body mass underneath the chip capacitor is achieved by side cores or recesses formed in the wall of the connector so that the chip capacitor sits on an outwardly extending lip.

4 Claims, 2 Drawing Sheets

PLATED PLASTIC FILTER HEADER

FIELD OF THE INVENTION

This invention relates to filter headers and more particularly to filter headers having surface-mounted chip capacitors.

BACKGROUND OF THE INVENTION

Filter headers are used in electronic module applications as a means for controlling electromagnetic interference (EMI). Many of these filter headers include a ferrite block for electrically filtering of high frequency signals and surface-mounted chip capacitors to provide a low impedance path-to-ground for high frequency signals. Some designs use spring contact members to interconnect the capacitor from the electrical terminals to ground. Other designs use an additional substrate layer which adds complexity to the manufacturing process. The present invention is based upon capacitors mounted directly on the plated surface of a connector body thus forming a three-dimensional printed circuit which greatly reduces the number of components of the assembly resulting in less cost and less manufacturing complexity.

However, the placement of chip capacitors on connector bodies poses unique problems when compared to similar designs on a flat printed circuit board. A primary failure mode for chip capacitors soldered to a substrate occurs during thermal cycling. The difference in the coefficient of thermal expansion between the substrate material and the ceramic chip capacitor creates stress in the solder fillet connecting the capacitor to the substrate. This problem is amplified when the substrate is a plated plastic connector body. The plastic connector body produces transient thermal gradients which result in localized failures of the solder fillets. The plastic materials typically have a greater coefficient of thermal expansion than that of typical printed circuit board materials. Furthermore, the basic connector body results in nonuniform thickness of the substrate area beneath the chip capacitor. Solutions to this problem would preferably have the ability to be incorporated into an existing package size, which in turn would allow the utilization of existing automated assembly equipment and also allow the filtered headers to be used interchangeably with existing non-filtered header connectors.

The present invention provides advantages over the prior art.

SUMMARY OF THE INVENTION

This invention includes a filtered header electrical connector including a connector body having a reduced mass underlying a surface-mounted chip capacitor. The reduced connector body mass underneath the chip capacitor is achieved by side cores or recesses formed in the skirt of the connector and arranged so that the chip capacitor sits on an outwardly extending lip of the connector. Alternatively, a core or recess is provided from the underside of the connector body skirt and constructed and arranged so that the chip capacitor sits on a thin bridge between the side walls of the skirt and the thicker pin retaining portion of the body.

These and other objects, features and advantages of the present invention will become apparent from the following brief description of the drawings, detailed description and appended claims and drawings.

DETAILED DESCRIPTION

Figure 1:
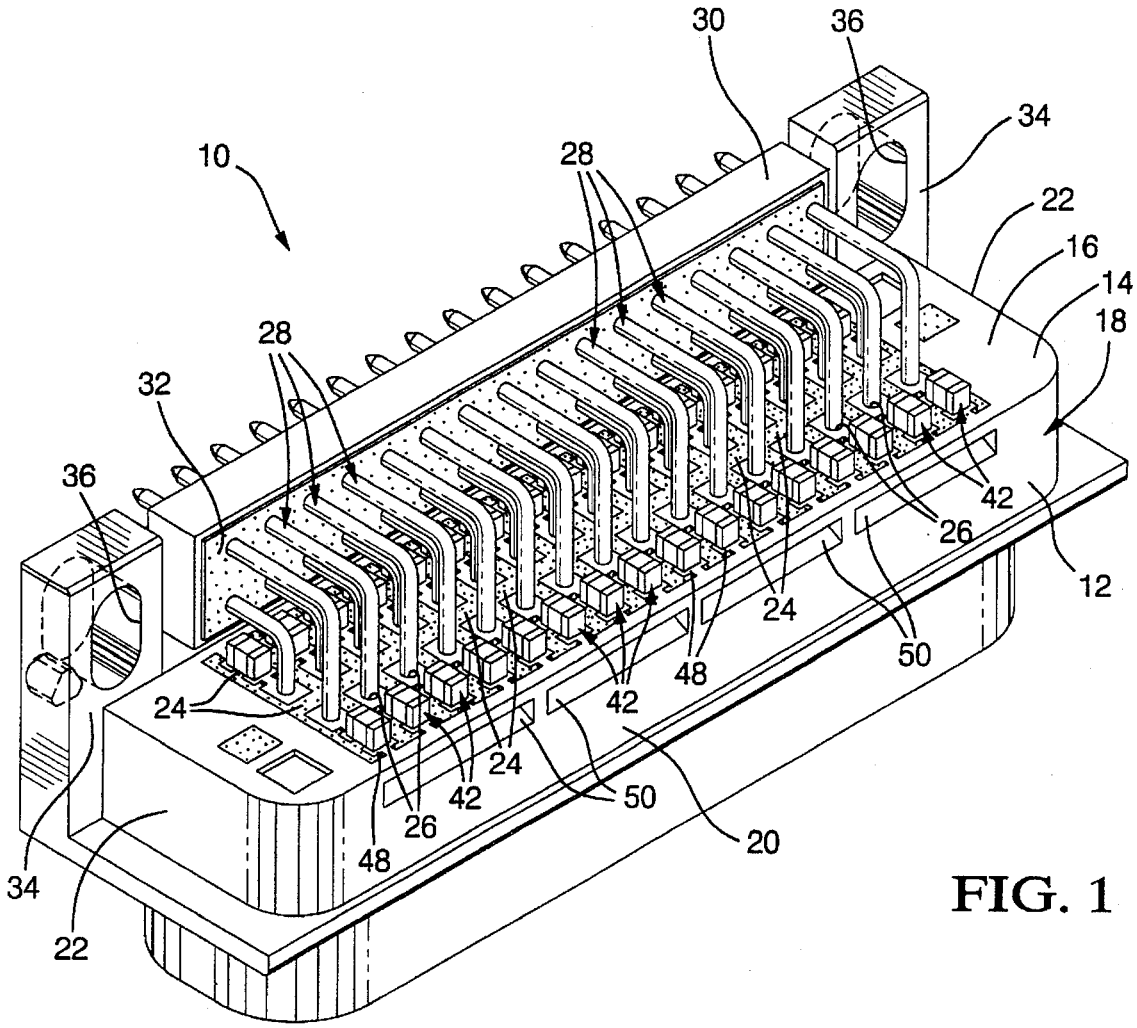
FIG. 1 is a perspective view of a filter header connector according to the present invention.
Figure 2:
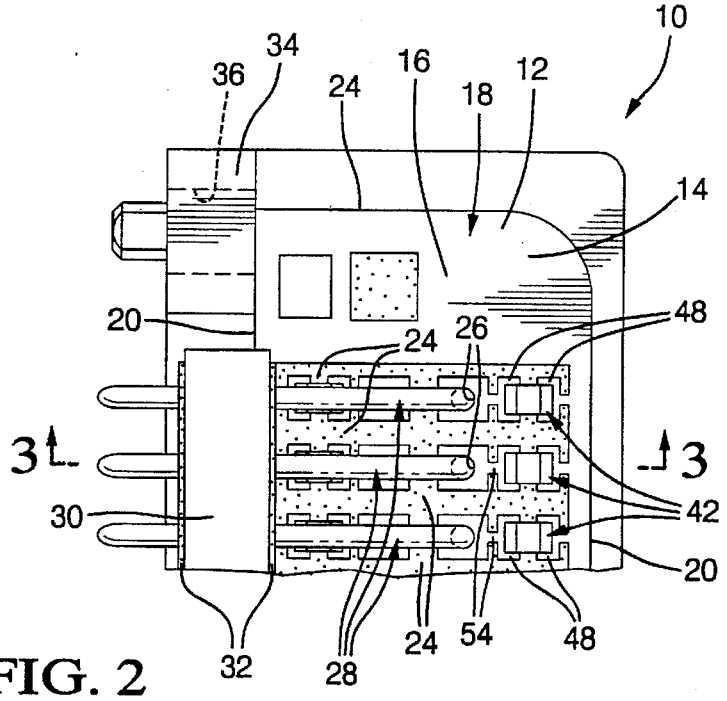
FIG. 2 is a top view of a filter header connector according to the present invention.

FIG. 1 illustrates a filter header connector 10 according to the present invention having a plastic connector body 12. The plastic connector body 12 is injection molded from a material under the trade name AMODEL™ A-1566 which is 65% glass and mineral filled and available from AMOCO company. The plastic connector body is plated with copper and then plated with tin 14. The connector body has a top surface 16 and a downwardly extending skirt 18 formed by two opposed side walls 20 and two opposed end walls 22. Thereafter, the top surface of the plated connector body is selectively etched to remove the copper and tin to provide plastic electrically insulating the etched locations 24 from the remainder of the plated connector body.

The top surface of the connector body includes a plurality of plated through holes 26 extending therethrough with each hole receiving a male terminal pin 28 which preferably are 1.0 mm pins.

Preferably the terminal pins are bent at 90 degrees at a location above the top surface of the connector body and extend through the ferrite block 30 and the two Mylar strips 32, one on each side of the block. The connector body may also include mounting flanges 34 having holes 36 formed therein. The terminal includes a star-shaped anchor 38 which is press-fit into a retainer portion 40 of the plastic connector body to hold the terminal in position. A chip capacitor 42 having two metal electrodes 44 is soldered 46 to a tin pad 48 left after the etching process. A suitable solder material is available from ESP company under the trade name SN63-565™. The use of surface-mounted capacitors provide a high degree flexibility in the selection of filter capacitance values and in the selection of special capacitance values on specific pins.

Figure 4:
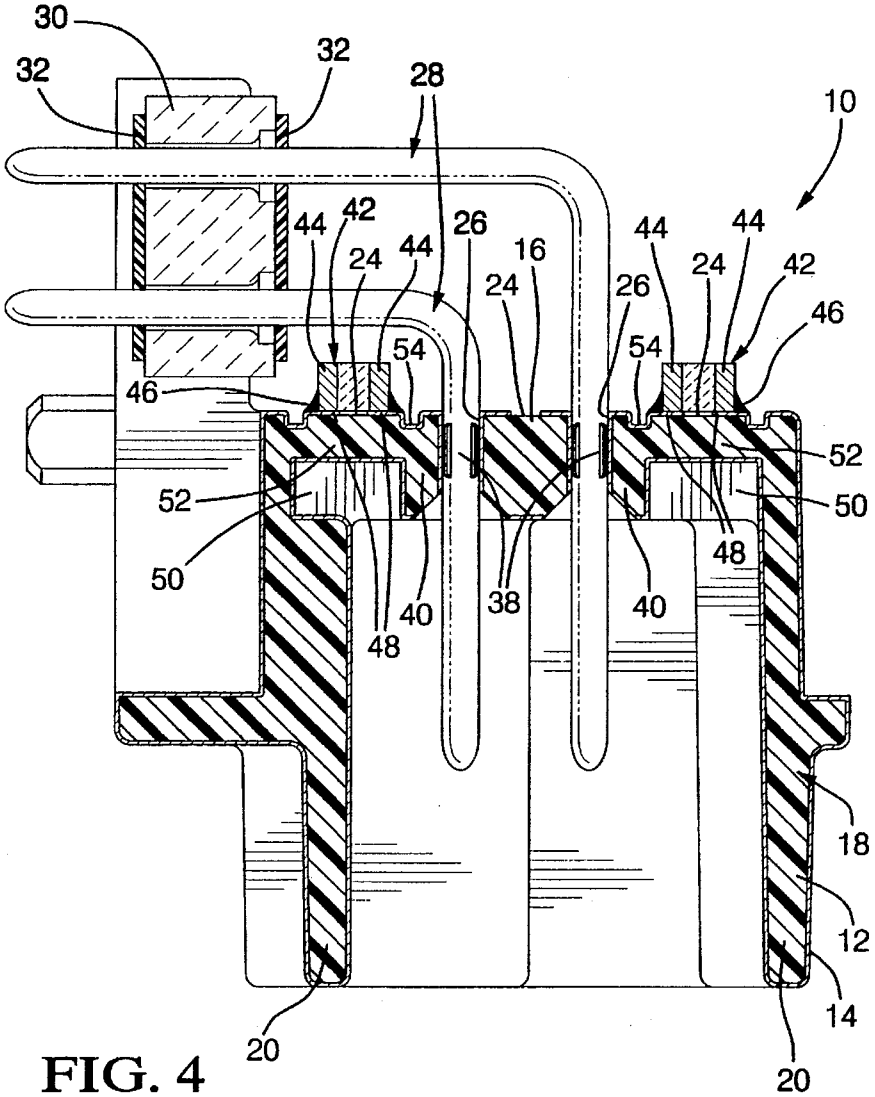
FIG. 4 is a sectional view similar to FIG. 3 of an alternative embodiment of the present invention.
Figure 3:
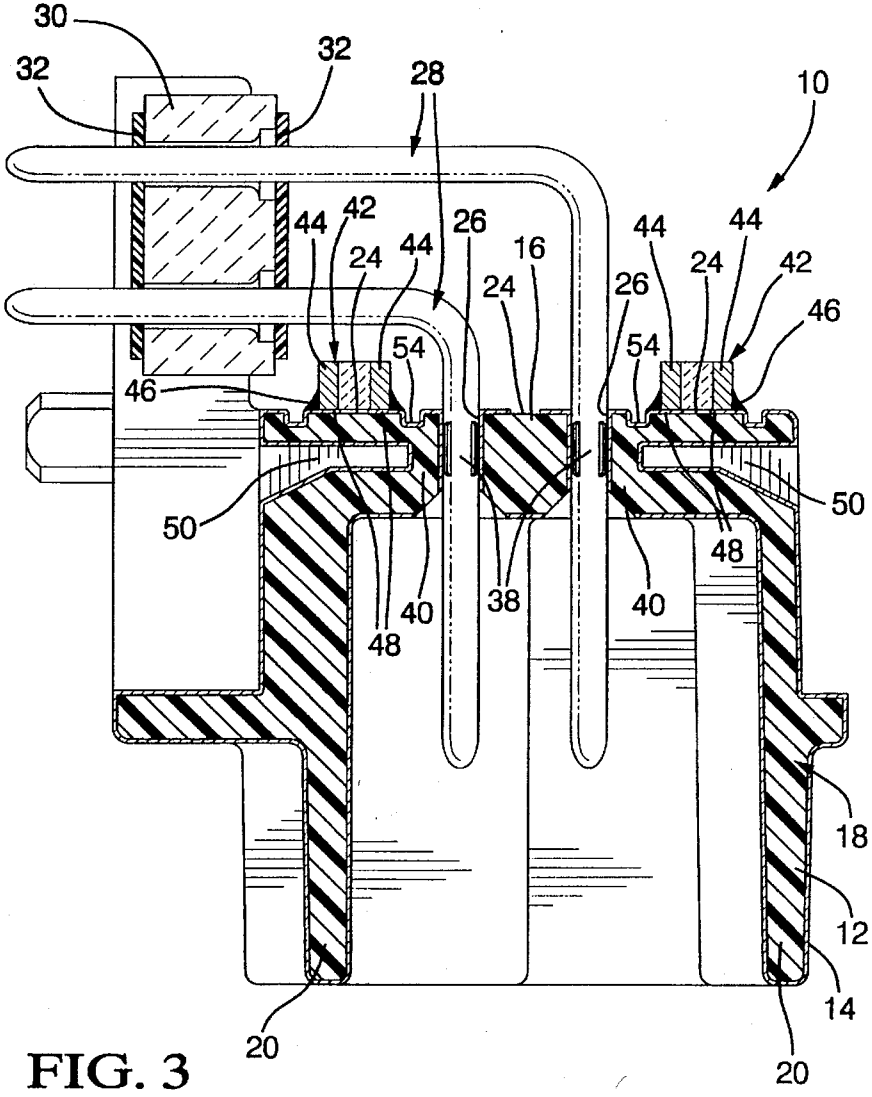
FIG. 3 is a sectional view taken along lines 3—3 of FIG. 2.

As shown in FIG. 3, each of the opposed side walls 20 of the skirt have cores or recesses 50 formed therein and constructed and arranged to provide a relatively thin ledge, lip, bridge or shelf on which the chip capacitor sits. This reduces the thermal mass underneath the chip capacitor and eliminates the problems associated with transient thermal gradients of thicker prior art plastic body connectors. Alternatively, as shown in FIG. 4, a thin bridge 52 can be provided under the chip capacitor and extending from the side walls 20 to the thicker retaining portion 40 of the body to define a recess 50. The shelf 52 and pin retainer portion define the recess 50 that provides a cooling channel underneath the chip capacitor.

The plated metal layer 14 on the plastic connector body provides a circuit trace 54 which forms low impedance electrical connection to the connector pins and a circuit trace 54 to provide a low impedance ground connection for the filter capacitors. The plated metal layer also serves to provide electromagnetic shielding.

A ferrite block 30 surrounds each pin to provide additional filtering and to allow the connectors to be used in conjunction with filter capacitors on modular circuit boards thus forming a $\pi$-filter circuit configuration. That is, a filter block is sandwiched between two capacitors. A Mylar strip 32 is placed both above and below the filter block to both retain the ferrite as well as to add stability to the pins.

This configuration system is, by design, very well suited for high speed automated assembly processes which insure high quality at low costs. These processes include conventional high-speed pick and place equipment for SMD placements as well as automated header assembly equipment for the insertion and bending of terminals. The placement of chip capacitors directly on connector bodies reduces the number of parts as well as reducing the assembly complexity. A major benefit of the design is the reduction of individual component parts as well as the simplification of assembly process. It also allows interchangeability with non-filtered headers of similar configurations, thus providing module designers the flexibility to add filtering to the module without redesigning either the PCB or box if filtering is required in any particular application.

The use of side cores or recesses in the skirt or the connector body to produce a lip, bridge or heat dissipating shelf on which the chip capacitors sit allows the connector body to function as a three-dimensional electronic circuit board. Conventional printed circuit boards are produced out of materials which typically have both a much lower coefficient of thermal expansion than plated engineering plastics as well as maintain dimensional stability and uniformity in cross sectional areas of 1.00 mm or less. This reduction of the coefficient of thermal expansion coupled with low thermal mass due to the volume of material directly underneath the solder joint cross-sectional area allows for a printed circuit board to have a functional temperature range (from −40° C.–125° C.) suitable for automotive applications. Our initial testing performed on designs without side cores or recesses revealed performance levels far below automotive application requirements. Subsequent designs which included the addition of side cores or recesses, and base material changes met all requirements for automotive underhood applications.

What is claimed is:

1. A filtered electrical header connector comprising:

a connector body comprising a pin retaining portion having a plurality of holes therethrough each for receiving a connector pin, a shelf connected along one side to the pin retainer portion and extending therefrom, and wherein the shelf has a thickness less than the thickness of the pin retainer portion, said connector body having a metal plating overlying selected portions thereof;

a terminal pin extending through each of said holes, a chip capacitor soldered to a pad of metal plating overlying said shelf, said chip capacitor electrically connected to one of said pin terminals and to another portion of the metal plating on said connector;

each of said terminal pins having a portion surrounded by a ferrite block, and wherein said shelf and pin retaining portion define a recess underlying said shelf and chip capacitor.

2. A filtered electrical header connector as set forth in claim 1 further comprising a skirt connected to a second side of said shelf and extending downward therefrom.

3. A filtered electrical header connector as set forth in claim 2 wherein said skirt, shelf and pin retaining portion define an enclosed recess that does not extend through the skirt.

4. A filtered electrical header connector as set forth in claim 1 further comprising a skirt connected to selected portions of a second side of said shelf and extending downward therefrom, said skirt being constructed and arranged to define said recess extending from an outer surface of said skirt and under said chip capacitor.

* * * * *